US006079093A

United States Patent [19]

Segerström

[11] Patent Number: 6,079,093

[45] Date of Patent: Jun. 27, 2000

[54] METHOD AND DEVICE FOR RELEASING CATHODE PLATES

[75] Inventor: Kjell Segerström, Karlstad, Sweden

[73] Assignee: Outokumpu Wenmec AB, Kil, Sweden

[21] Appl. No.: 08/945,248

[22] PCT Filed: May 2, 1996

[86] PCT No.: PCT/SE96/00565

§ 371 Date: Oct. 22, 1997

§ 102(e) Date: Oct. 22, 1997

[87] PCT Pub. No.: WO96/35007

PCT Pub. Date: Nov. 7, 1996

[30] Foreign Application Priority Data

May 4, 1995 [SE] Sweden ..... 9501662

[51] Int. Cl.[7] ..... B23P 19/00; B26F 3/00; C25D 1/00; C25D 17/00

[52] U.S. Cl. ..... 29/426.5; 225/98; 204/281; 204/227

[58] Field of Search ..... 205/67, 76, 77, 205/137; 204/281, 227; 29/426.5; 225/98

[56] References Cited

U.S. PATENT DOCUMENTS

| | | | |
|---|---|---|---|
| 4,027,378 | 6/1977 | Wennberg et al. | 29/427 |
| 5,376,062 | 12/1994 | Zeichner | 483/55 |
| 5,828,647 | 10/1998 | Lee et al. | 369/192 |

FOREIGN PATENT DOCUMENTS

| | | |
|---|---|---|
| 1661248 | 7/1991 | Russian Federation . |
| 382647 | 12/1975 | Sweden . |

*Primary Examiner*—Kathryn Gorgos
*Assistant Examiner*—Edna Wong
*Attorney, Agent, or Firm*—Smith-Hill and Bedell

[57] ABSTRACT

A method and a device for releasing electrolytically deposited cathode plates from each side of a mother plate. At least one roller is pressed against the surface of the deposited cathode plate, and the roller is moved along the surface of the deposited cathode plate in order to cause the release of the deposited cathode plate from the mother plate at least in the rolled area.

27 Claims, 2 Drawing Sheets

METHOD AND DEVICE FOR RELEASING CATHODE PLATES

This is a national stage application of PCT/SE96/00565 filed May 2, 1996.

TECHNICAL FIELD

The invention relates to a method and a device for releasing electrolytically deposited cathode plates from each side of a mother plate.

BACKGROUND OF THE INVENTION

In electrolytical refining of copper and other metals, cathode plates are deposited on each side of mother plates. According to a technique used in the past, a comparatively thin layer is deposited on the mother plate, so called starting sheets, which may have a thickness up to approximately 1 mm. The starting sheets are stripped form the mother plates and are used in a subsequent stage as cathodes, in order to be coated with more electrolytically deposited metal to a full thickness. According to modem technique, however, no starting sheets are produced. Instead, the electrolytically deposited metal is accumulated to the intended full thickness on the original mother plate, which may consist e.g. of stainless acid resistant steel, titanium or other metal, according to so called full deposit technique.

Whether it is the question of starting sheet production or of full deposit technique, one has encountered problems in connection with the stripping of the deposited cathode plates from the mother plate. Various methods have been employed, including the application of bending forces, impacts, vibrations, etc., but no ideal method so far has been suggested in prior art. Either the suggested and/or employed methods have not been sufficiently efficient or have caused damages on the mother plates or on other equipment. Therefore, there exists a need to solve these problems in a better mode than according to the technique of today.

BRIEF DISCLOSURE OF THE INVENTION

It is the purpose of the invention to solve the above mentioned problems. Characteristic features and aspects of the invention are apparent from the following description of a preferred embodiment.

According to the invention at least one roller is pressed to the surface of the deposited cathode plate and that roller is moved a distance along the surface of the deposited cathode plate. The distance at which the roller will press the cathode plate is between 0 and 50 mm, preferably not more than 15 mm from the upper edge of the cathode plates. The roller pressed against the cathode plate, is moved a distance, the total length of which corresponds to 20 to 100% of the length of the plate assembly, preferably 40 to 80% of the length of the plate assembly. The pressing and the movement cause the release of the deposited cathode plate from the mother plate at least in the rolled area. The deposited cathode plate is then completely released from the mother plate in the stripping operation proper.

The pressing can be carried out by at least one roller pair with the rollers positioned on the opposite side of the plate assembly. Then the rollers are pressed towards each other with the plate assembly between them and they are syncronously moved a rolling distance in the region of an edge part of the cathode plate. The cathode plates are disengaged from the mother plate at least in that edge portion of the cathode plates. It is also possible to use in accordance with the invention two roller pairs, one pair on one side of the plate assembly and the other at the opposite side of the plate assembly so that the roller pair are moved under pressure in opposite directions from each other. These two roller pairs can also be used so that the roller pairs are moved away from each other from the central starting positions in directions towards the outer edges of the plate assembly.

BRIEF DESCRIPTION OF THE DRAWINGS

In the following description of a preferred embodiment, reference will be made to the accompanying drawings, in which.

DESCRIPTION OF A PREFERRED EMBODIMENT

Figure 1:
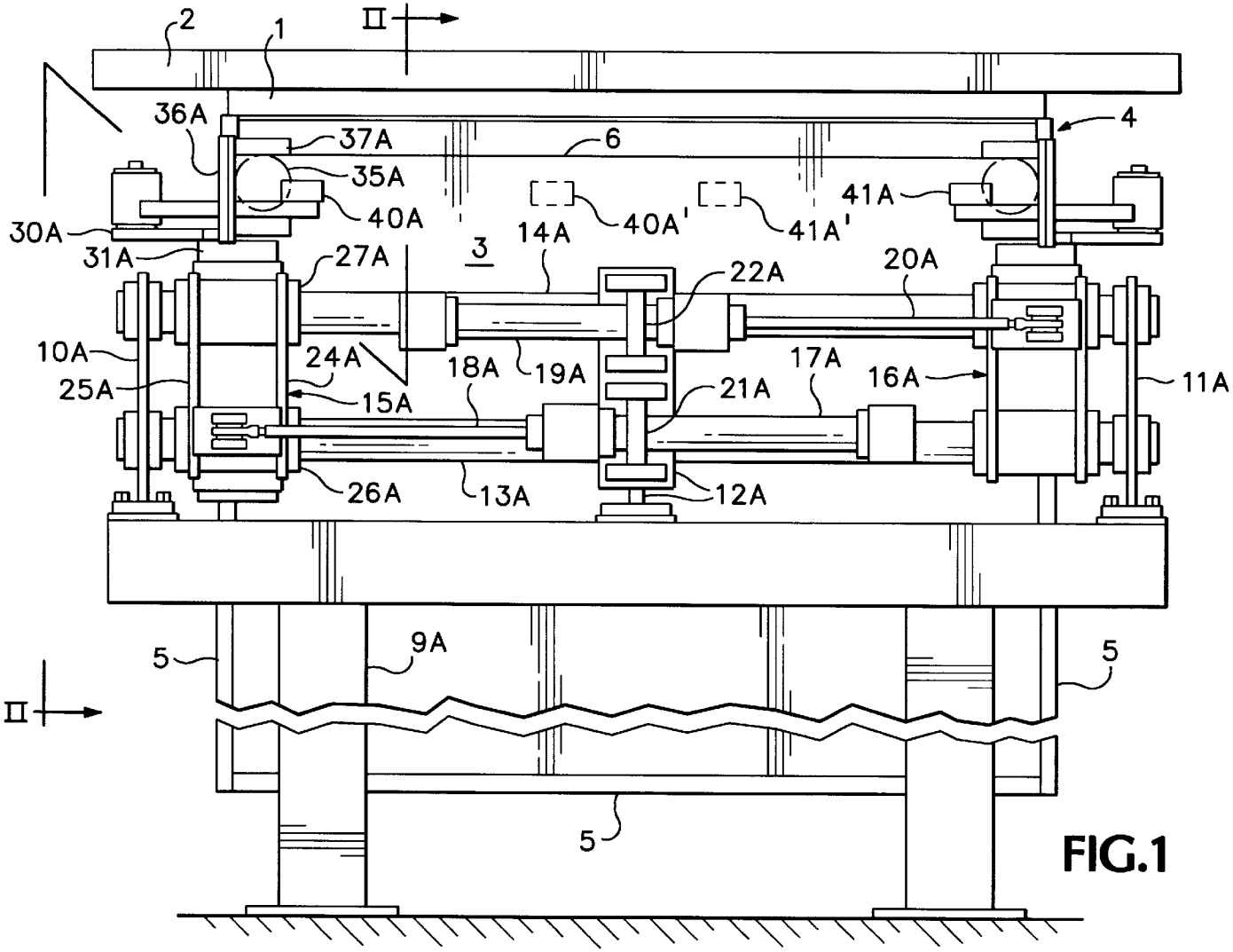
FIG. 1 is a side elevation of the device according to the preferred embodiment.

In the drawings, a mother plate is generally designated by numeral 1. The mother plate is secured to a cathode rod 2, which is suspended in a not shown feeder. A metal deposition 3, which is about 3 to 8 mm thick, a so called full deposit cathode, is deposited on each side of the mother plate 1, which is about 3 to 6 mm thick, up to a horizontal edge 6. The plate assembly, consisting of the mother plate 1 and the cathode plates 3, is generally designated 4. Along the side edges, and in the present case also along the bottom edge, there is an edge strip 5, which prevents the electrolytically deposited plates 3 from growing together during the electrolytic operation. The plate assembly 4 is approximately square having a side length of about 1 m.

The device shown in the drawings is intended to release the cathode plates initially from the mother plate in a pre-stripping station in an integrated, automatic line for the handling of the plate assemblies 4, the stripped cathode plates 3, and the mother plates 1. The complete separation or stripping of the cathode plates from the mother plate is intended to be performed in a subsequent station in a way which can be performed according to a technique which may be known per se.

Figure 2:
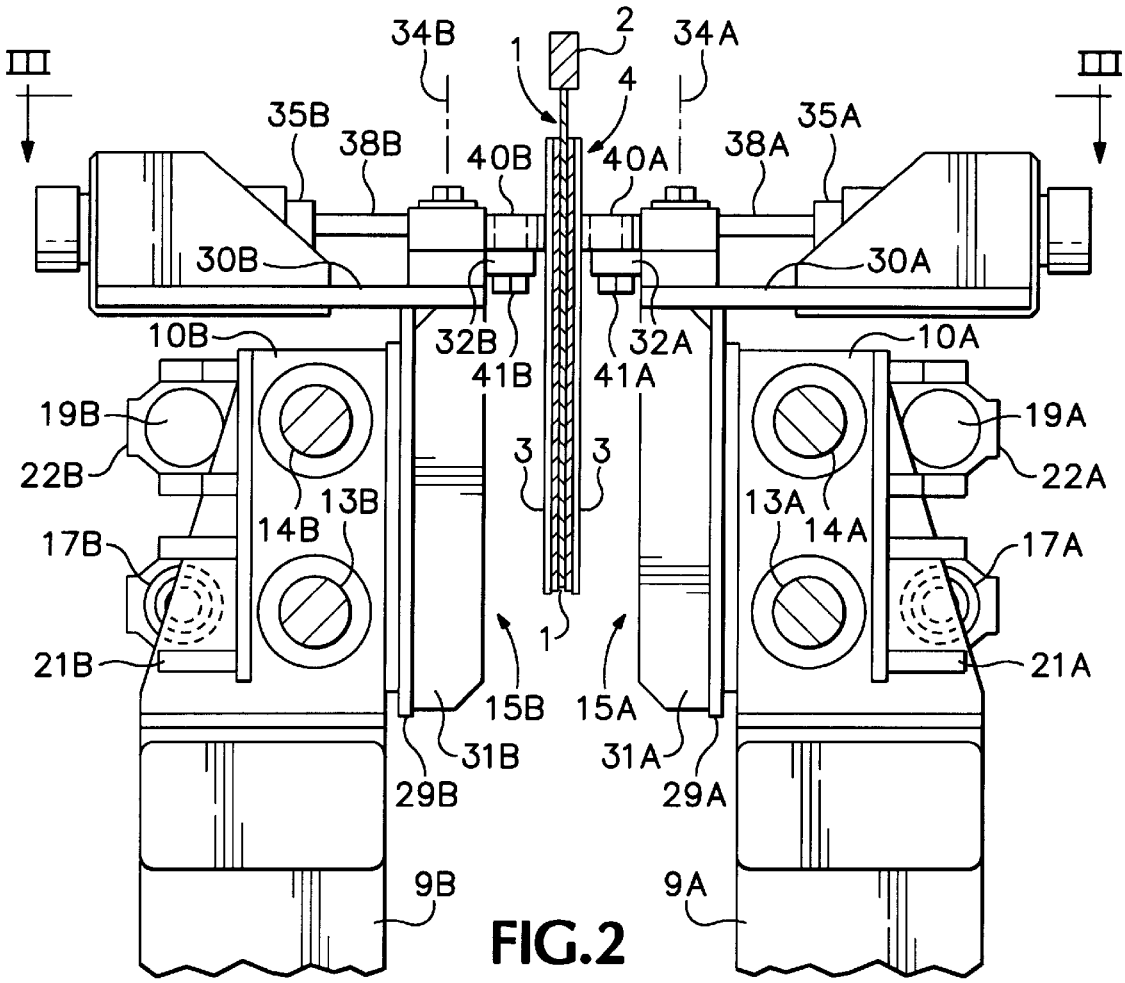
FIG. 2 is a view along the line II—II in FIG. 1.
Figure 3:
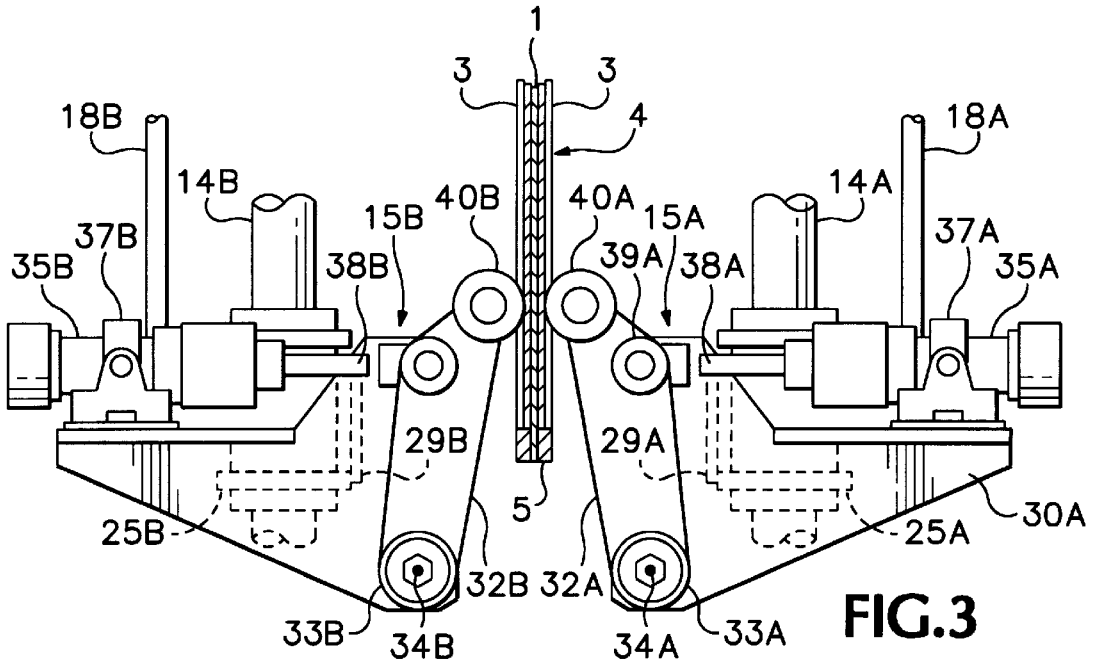
FIG. 3 is a view along the line III—III in FIG. 2.

The device shown in the drawings is in other words a pre-stripping machine consisting of two units, which are equally but invertedly designed, one on each side of the vertically suspended plate assembly 4, which is moved step-wise forward along a conveying path, the longitudinal direction of which coincides with the side extension of the plate assembly 4. In FIG. 2, the pre-stripping machine is viewed in the conveying direction of the plate assembly. The unit on the right hand side is generally designated A, and the unit on the left hand side is designated B. In the following, only the right hand side unit A will be described more in detail, as the unit B is correspondingly designed and therefore does not require any separate description. The reference numerals for parts belonging to the units A and B have been given the suffixes A and B, respectively.

Two outer, vertical posts 10A and 11A and a central post 12A are mounted on a foundation or support frame 9A. Two horizontal guides, namely a lower guide 13A and an upper guide 14A extend between the outer posts 10A and 11A and behind the central post 12A, with reference to FIG. 1. Two slides are slidably mounted on the guides 13A and 14A, namely a left hand slide 15A and a correspondingly, but invertedly designed right hand slide 16A. The slides 15A, 16A can be moved on the guides 13A, 14A between inner starting positions and outer final positions. The slides 15A, 16A are shown in their final posititons in FIG. 1. A lower hydraulic cylinder 17A having a piston rod 18A is provided for the movements of the left hand slide 15A along the guides 13A, 14A and for the movements of the right hand slide 16A there is provided an upper hydraulic cylinder 19A with a piston rod 20A. The hydraulic cylinders 17A, 19A are mounted on the central post 12A by means of cylinder fastening brackets 21A and 22A, respectively, and will in the following be referred to as rolling cylinders. The piston rods 18A, 20A are attached to the slides 15A and 16A, respectively.

Each slide, such as the slide 15A, consist of a pair of vertical, parallel plates 24A, 25A, and between these plates a lower and an upper sliding sleeve 26A and 27A, respectively, which surround the guides 13A, 14A. Further, a back plate 29A extends between the parallel plates 24A and 25A. On the back plate 29A, there is a carrier or carriage 30A, which has the shape of an upper, horizontal plate fastened through a vertical fastening element 31A. A lever or pivot arm 32A is pivotably mounted on the carrier 30A through a pivot 33A. The lever 32A can be pivoted in a horizontal plane about the centre of rotation 34A of the pivot 33A. The motion means is a hydraulic cylinder 35A, in the following referred to as pressing cylinder, which is mounted on a vertical mounting means 36A on the carrier 30A through a hinged cylinder bracket 37A. The piston rod 38A is in its front end pivotably fastened to the lever 32A through a front pivot 39A. In the free, front end of the lever 32A there is a steel roller 40A, which can rotate about a vertical centre of rotation 41A.

The above described equipment is operated in the following way. First the slides 15A/15B, 16A/16B (not shown) are brought back to their central starting positions by means of the rolling cylinders 17A/17B, 19A/19B. The rollers 40A/40B, 41A/41B (the latter one not shown) are brought back by means of their respective pressing cylinders, such as the pressing cylinders 35A/35B. The positions of the rollers in their starting positions are shown through the rollers 40A' and 41A' shown through dashed lines in FIG. 1.

A plate assembly 4 is entered between on one side the rollers 40A and 41A, and on the other side the rollers 40B and 41B. Thereafter, the rollers are brought pairwise towards each other, i.e. rollers 40A and 40B are brought towards each other, and the rollers 41A and 41B are correspondingly brought towards each other by means of their respective pressing cylinders, represented by the hydraulic cylinders 35A and 35B, and are pressed against the plate assembly 4 under a heavy pressing power at a distance of between 0 and 50 mm, preferably about 15 mm from the upper edge 6 of the cathode plates 3.

The distance between the roller pairs, i.e. between on one side the rollers 40A/40B and on the other side the rollers 41A/41B, is 200 mm in the starting position according to the embodiment. From this starting position, the rollers are moved away from each other, i.e. the rollers 40A/40B are moved to the left with reference to FIG. 1, while the rollers 41A/41B are moved to the right, which is accomplished therein, that the slides, as the slides 15A and 16A, and 15B and 16B (not shown), respectively, moved away from each other by means of the rolling cylinders 17A, 19A and 17B, 19B, respectively, at the same time as the rollers 40A, 40B and 41A, 41B, respectively, are pressed towards each other and against the plate assembly by the pressing cylinders. The rolling distance for each roller pair 40A/40B, and 41A/41B, respectively, according to the embodiment is 300 mm. This is sufficient for causing the cathode plates 3 to be disengaged from the mother plate 1 in the upper part of the plate assembly 4. When the rollers 40A/40B have reached their outer end positions, they are displaced from the plate assembly 4 by means of their respective pressing cylinder; such as the pressing cylinder 35A. The plate assembly 4 with the now initially released cathode plates 3 then is moved farther on for complete stripping, and the slides 15A/16A, 15B/16B are returned to the their starting positions.

What is claimed is:

1. A method of processing a plate assembly which comprises a mother plate and first and second electrolytically deposited cathode plates adhering to respective sides of the mother plate, the method comprising:

(a) positioning a roller adjacent a surface of the first cathode plate, the roller having an axis of rotation, (b) pressing the roller against the surface of the first cathode plate, and (c) bringing about relative movement of the roller and the plate assembly in a direction perpendicular to the axis of rotation of the roller, whereby the roller rolls over the surface of the first cathode plate and the roller exerts on the first cathode plate a force that is substantially exclusively perpendicular to the surface of the cathode plate and weakens adhesion of the first cathode plate to the mother plate.

2. A method according to claim 1, comprising positioning the plate assembly so that it is vertical and the first cathode plate has an upper edge, and wherein step (b) comprises pressing the roller against the surface of the first cathode plate at a distance of not more than 50 mm from the upper edge of the cathode plate.

3. A method according to claim 1, comprising positioning the plate assembly so that it is vertical and the first cathode plate has an upper edge, and wherein step (b) comprises pressing the roller against the surface of the first cathode plate at a distance of not more than 15 mm from the upper edge of the cathode plate.

4. A method according to claim 1, wherein the plate assembly comprises a cathode rod to which the mother plate is attached and the method comprises positioning the cathode rod substantially horizontally with the mother plate depending vertically therefrom and pressing the roller against the surface of the first cathode plate at a distance of not more than 50 mm from an upper edge of the first cathode plate.

5. A method according to claim 1, wherein the plate assembly has a longitudinal extent parallel to the direction of relative movement of the roller and the plate assembly and step (c) comprises bringing about relative movement of the roller and the plate assembly over a distance which corresponds to 20 to 100% of the longitudinal extent of the plate assembly.

6. A method according to claim 1, wherein the plate assembly has a longitudinal extent parallel to the direction of relative movement of the roller and the plate assembly and step (c) comprises bringing about relative movement of the roller and the plate assembly over a distance which corresponds to 40 to 80% of the longitudinal extent of the plate assembly.

7. A method according to claim 1, wherein step (c) comprises holding the plate assembly stationary relative to a support frame and moving the roller relative to the support frame.

8. A method of processing a plate assembly which comprises a mother plate and first and second electrolytically deposited cathode plates adhering to respective sides of the mother plate, the method comprising:

(a) positioning a pair of first and second rollers adjacent respective surfaces of the first and second cathode plates respectively, whereby the plate assembly is located between the first and second rollers, the first and second rollers having first and second axes of rotation respectively, said first and second axes of rotation being mutually parallel, (b) pressing the first and second rollers powerfully towards each other, whereby the first and second rollers engage the respective surfaces of the first and second cathode plates, the first and second rollers engaging the first and second cathode plates in respective edge regions thereof, (c) bringing about movement of the first and second rollers relative to the plate assembly in a direction perpendicular to said axes of rotation, while the first and second rollers continue to be pressed powerfully towards each other and continue to engage the respective edge regions of the first and second cathode plates, whereby the rollers roll over the respective surfaces of the first and second cathode plates in the edge regions thereof and the rollers exert on each cathode plate a force that is substantially exclusively perpendicular to the surface of the cathode plate, (d) disengaging the first and second rollers from the plate assembly, and subsequently (e) separating the first and second cathode plates from the mother plate.

9. A method according to claim 8, comprising positioning the plate assembly so that it is vertical and each cathode plate has an upper edge, and wherein step (b) comprises pressing the rollers against the surfaces of the respective cathode plates each at a distance of not more than 50 mm from the upper edge of the respective cathode plate.

10. A method according to claim 8, comprising positioning the plate assembly so that it is vertical and each cathode plate has an upper edge, and wherein step (b) comprises pressing the rollers against the surfaces of the respective cathode plates each at a distance of not more than 15 mm from the upper edge of the respective cathode plate.

11. A method according to claim 8, wherein the plate assembly comprises a cathode rod to which the mother plate is attached and the method comprises positioning the cathode rod substantially horizontally with the mother plate depending vertically therefrom and pressing the rollers against the surfaces of the respective cathode plates each at a distance of not more than 50 mm from an upper edge of the respective cathode plate.

12. A method according to claim 8, wherein the plate assembly has a longitudinal extent parallel to the direction of relative movement of the rollers and the plate assembly and step (c) comprises bringing about relative movement of the rollers and the plate assembly over a distance which corresponds to 20 to 100% of the longitudinal extent of the plate assembly.

13. A method according to claim 8, wherein the plate assembly has a longitudinal extent parallel to the direction of relative movement of the rollers and the plate assembly and step (c) comprises bringing about relative movement of the rollers and the plate assembly over a distance which corresponds to 40 to 80% of the longitudinal extent of the plate assembly.

14. A method according to claim 8, comprising:

positioning a pair of third and fourth rollers adjacent respective surfaces of the first and second cathode plates respectively, whereby the plate assembly is located between the third and fourth rollers, the third and fourth rollers having third and fourth axes of rotation respectively, said third and fourth axes of rotation being parallel to said first and second axes of rotation, pressing the third and fourth rollers powerfully towards each other, whereby the third and fourth rollers engage the respective surfaces of the first and second cathode plates, the third and fourth rollers engaging the first and second cathode plates in respective edge regions thereof, bringing about movement of the third and fourth rollers relative to the plate assembly in a direction perpendicular to said axes of rotation while the third and fourth rollers continue to be pressed powerfully toward each other and continue to engage the respective edge regions of the first and second cathode plates, whereby the rollers roll over the respective surfaces of the first and second cathode plates in the edge regions thereof and the rollers exert on each cathode plate a force that is substantially exclusively perpendicular to the surface of the cathode plate, and disengaging the third and fourth rollers from the plate assembly, and wherein the direction of movement of the third and fourth rollers relative to the plate assembly while the third and fourth rollers continue to be pressed powerfully toward each other and continue to engage the respective edge regions of the first and second cathode plates is opposite the direction of movement of the first and second rollers relative to the plate assembly in step (c).

15. A method according to claim 14, wherein the first and second rollers roll over the respective surfaces of the first and second cathode plates towards the first edge of the plate assembly and the third and fourth rollers roll over the respective surfaces of the first and second cathode plates towards the second edge of the plate assembly.

16. A device for processing a plate assembly which comprises a mother plate and first and second electrolytically deposited cathode plates adhering to respective sides of the mother plate, the device comprising:

a roller having an axis of rotation, a first means for positioning the plate assembly with a surface of the first cathode plate adjacent the roller, a second means for pressing the roller against the surface of the first cathode plate, and a third means for bringing about relative movement of the roller and the plate assembly in a direction perpendicular to the axis of rotation of the roller, whereby the roller rolls over the surface of the first cathode plate and the roller exerts on the first cathode plate a force that is substantially exclusively perpendicular to the surface of the cathode plate and weakens adhesion of the first cathode plate to the mother plate.

17. A device according to claim 16, further comprising:

a second roller having an axis of rotation, the axis of rotation of the second roller being parallel to the axis of rotation of the first mentioned roller, a fourth means for pressing the second roller against the surface of the first cathode plate when the plate assembly is positioned with the surface of the first cathode plate adjacent the first mentioned roller, and a fifth means for bringing about relative movement of the second roller and the plate assembly in a direction perpendicular to said axes of rotation, whereby the second roller rolls over the surface of the first cathode plate and the second roller exerts on the first cathode plate a force that is substantially exclusively perpendicular to the surface of the cathode plate and weakens adhesion of the first cathode plate to the mother plate, and wherein the third means and the fifth means cause the second roller and the first mentioned roller to roll in opposite respective directions.

18. A device according to claim 17, wherein the third means and the fifth means cause the second roller and the first mentioned roller to roll away from each other.

19. A device according to claim 16, comprising a support frame and wherein the first means positions the plate assembly stationarily relative to the support frame and the third means brings about movement of the roller relative to the support frame while the plate assembly remains stationary relative to the support frame.

20. A device for processing a plate assembly which comprises a mother plate and first and second electrolytically deposited cathode plates adhering to respective sides of the mother plate, the device comprising:

a pair of first and second rollers having first and second axes of rotation respectively, said first and second axes of rotation being mutually parallel, a first means for locating the plate assembly between the first and second rollers, a second means for selectively pressing the first and second rollers powerfully towards each other, whereby the first and second rollers engage the respective surfaces of the first and second cathode plates, and moving the first and second rollers apart, whereby the first and second rollers are disengaged from the respective surfaces of the first and second cathode plates, and a third means for bringing about movement of the first and second rollers relative to the plate assembly in a direction perpendicular to said axes of rotation while the first and second rollers are pressed powerfully towards each other and engage respective edge regions of the first and second cathode plates, whereby the rollers roll over the respective surfaces of the first and second cathode plates in the edge regions thereof and the rollers exert on each cathode plate a force that is substantially exclusively perpendicular to the surface of the cathode plate.

21. A device according to claim 20, comprising a support frame and wherein the first means locates the plate assembly stationarily relative to the support frame.

22. A device according to claim 21, further comprising first and second elongate guides mounted to the support frame on opposite respective sides of the location of the plate assembly, whereby the plate assembly is disposed between the first and second guides, and first and second slides mounted on and moveable along the first and second guides respectively, and wherein the first and second rollers are mounted on the first and second slides respectively, and the third means is effective between the support frame and the first and second slides for moving the first and second slides along the first and second guides respectively.

23. A device according to claim 22, wherein the plate assembly comprises a cathode rod to which the mother plate is attached and the first means locates the plate assembly with the cathode rod horizontal and with upper edges of the first and second cathode plates substantially horizontal, the first and second guides are substantially horizontal, and the first and second slides include bearing means for supporting the first and second rollers for rotation about substantially vertical axes.

24. A device according to claim 23, wherein the first and second slides include first and second carriages respectively and first and second pivot arms respectively, each pivot arm having a proximal end and a distal end, the first and second pivot arms being mounted at their respective proximal ends to the first and second carriages for pivoting with respect thereto about respective vertical pivot axes, the first and second rollers are mounted at the distal ends of the first and second pivot arms respectively, and the second means comprises first and second actuators each effective between a respective carriage and the pivot arm that is pivotally mounted to the carriage, the actuator acting on the pivot arm at a location spaced from the proximal end of the arm for pivoting the arm about the respective pivot axis.

25. A device according to claim 20, further comprising a pair of third and fourth rollers having third and fourth axes of rotation respectively, the third and fourth axes of rotation being parallel to the first and second axes of rotation, and wherein the first means locates the plate assembly between the third and fourth rollers and between the first and second rollers and the device further comprises a fourth means for selectively pressing the third and fourth rollers powerfully towards each other, whereby the third and fourth rollers engage the respective surfaces of the first and second cathode plates, and moving the third and fourth rollers apart, whereby the third and fourth rollers are disengaged from the respective surfaces of the first and second cathode plates.

26. A device according to claim 25, further comprising a fifth means for bringing about movement of the third and fourth rollers relative to the plate assembly in a direction perpendicular to said axes of rotation while the third and fourth rollers are pressed powerfully towards each other and engage respective edge regions of the first and second cathode plates, whereby the third and fourth rollers roll over the respective surfaces of the first and second cathode plates in the edge regions thereof and the third and fourth rollers exert on each cathode plate a force that is substantially exclusively perpendicular to the surface of the cathode plate.

27. A device according to claim 26, wherein the third means brings about movement of the first and second rollers away from the third and fourth rollers and the fifth means brings about movement of the third and fourth rollers away from the first and second rollers.

* * * * *